US009084908B1

(12) United States Patent
Chen

(10) Patent No.: US 9,084,908 B1
(45) Date of Patent: Jul. 21, 2015

(54) TRAMPOLINE BASKETBALL GOAL

(71) Applicant: Samuel Chen, Shanghai (CN)

(72) Inventor: Samuel Chen, Shanghai (CN)

( * ) Notice: Subject to any disclaimer, the term of this patent is extended or adjusted under 35 U.S.C. 154(b) by 38 days.

(21) Appl. No.: 14/158,961

(22) Filed: Jan. 20, 2014

(51) Int. Cl.
*A63B 21/00* (2006.01)
*A63B 5/11* (2006.01)
*A63B 63/08* (2006.01)

(52) U.S. Cl.
CPC ..... *A63B 5/11* (2013.01); *A63B 63/083* (2013.01)

(58) Field of Classification Search
CPC ..... A63B 21/00
USPC ..... 482/27–29
See application file for complete search history.

(56) References Cited

U.S. PATENT DOCUMENTS

| | | | | | |
|---|---|---|---|---|---|
| 3,339,925 | A | * | 9/1967 | Nissen | 473/469 |
| 5,607,377 | A | * | 3/1997 | Wilkinson | 482/83 |
| 5,785,616 | A | * | 7/1998 | Dodge | 473/479 |
| 5,833,557 | A | * | 11/1998 | Cole | 473/472 |
| 6,135,922 | A | * | 10/2000 | Nissen | 482/27 |

* cited by examiner

*Primary Examiner* — Jerome W Donnelly
(74) *Attorney, Agent, or Firm* — Clement Cheng

(57) ABSTRACT

The trampoline basketball goal includes a frame, a bed and springs connecting the bed to the frame. The trampoline enclosure includes enclosure poles holding an enclosure net. The enclosure poles have an upper end and a lower end. The enclosure poles comprise a first enclosure pole, a second enclosure pole, and a third enclosure pole. The first enclosure pole, the second enclosure pole, and the third enclosure pole are placed around a periphery of the trampoline bed. The first trampoline pole is adjacent to the second trampoline pole, and the second trampoline pole is adjacent to the third trampoline pole. A basketball backboard is suspended between the first and third enclosure poles.

14 Claims, 1 Drawing Sheet

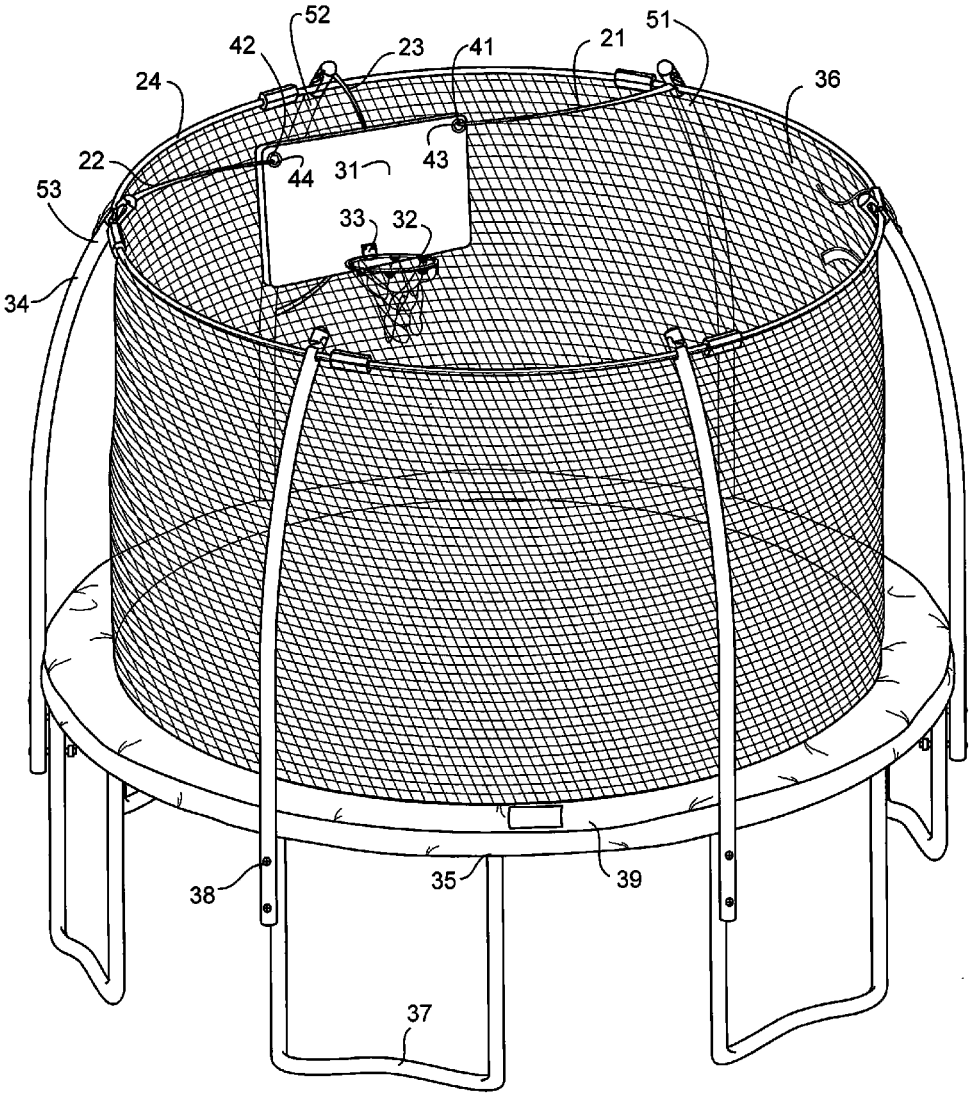
52
42
23
41
21
51
24
36
22
44
31
43
53
33
32
34
38
35
39
37

TRAMPOLINE BASKETBALL GOAL

FIELD OF THE INVENTION

The present invention is in the field of trampoline basketball goals.

DISCUSSION OF RELATED ART

A variety of trampoline games have been played on trampolines, such as basketball. Publicover describes a trampoline game accessory in United States publication 20050043122 published Feb. 24, 2005, the disclosure of which is incorporated herein by reference. The trampoline game includes a variety of electronic buttons located above a trampoline bed. Publicover in United States publication 20100190608 of Jul. 29, 2000 and describes a trampoline game system with additional optional accessories including variations of tag, hopscotch, volleyball, basketball and other modifications of traditional games which may include scoring a goal with a ball. Colling in U.S. Pat. No. 7,481,740 issued Jan. 27, 2009 includes a soccer goal fitted on a portion of a trampoline enclosure net. Other devices such as Chen in U.S. Pat. No. 6,918,846 provides for an inflatable basketball structure which can also be used for enclosing a trampoline structure. Traditionally, a trampoline structure consists of a bottom frame for support and a base bed to jump on. However, even though trampolines may be structurally sound and sturdily built, trampoline use has an inherent risk of injury. Thus, inventions through the years have sought to reduce that risk such as the following. Mark Publicover, U.S. Pat. No. 6,261,207, issued Jul. 17, 2001, entitled Trampoline or the Like with Enclosure, which is disclosed herein by reference.

Different inventors have created a variety of different trampoline basketball systems for enabling shorter people to have unique interactions with a basketball goal such as Edward Cole, in U.S. Pat. No. 5,833,557, issued on Nov. 10, 1998, entitled Trampoline Basketball Game, the disclosure of which is incorporated herein by reference. Cole describes a trampoline basketball game structure, which comprises of an elevated horizontal rebound surface, two opposing and facing basketball hoops, and a resilient barrier separating the horizontal rebound surface into two playing areas. Score may also be kept on a board placed on beams near the middle of the structure. Additionally, Devin Ronan, in U.S. Pat. No. 8,328,695, issued Dec. 11, 2012, entitled Trampoline and Cage Ball Game Device, also discloses a novel game, the disclosure of which is incorporated herein by reference. Ronan describes a trampoline and cage ball game device, where a single continuous open ended sheet of flexile material, folded and reinforced at four corners, thus creating four defined wall panels and forming an enclosed cage structure.

Trampoline basketball structures can also be inflatable as described by Samuel Chen in U.S. Pat. No. 6,918,846, issued on Jul. 19, 2005, entitled Inflatable Basketball Structure, the disclosure of which is incorporated herein by reference. The structure when used in conjunction with a trampoline allows users to perform vertically challenging feats, such as slamdunking. George Nissen, also describes a ballgame in U.S. Pat. No. 6,135,922, issued Jul. 19, 2005, entitled Trampoline Attachment, the disclosure of which is incorporated herein by reference. Nissen teaches about an attachment system for use with a circular trampoline, where a basic trampoline is improved upon to include four arch-shaped backstop frames, an apex and two ends, which are attached to the base frame.

The center has two arched frames, and a hollow cylindrical structure suspended to the center frames where a projectile may pass through.

Mark Publicover, in U.S. Pat. No. 7,429,227, issued Sep. 30, 2008, entitled Basketball Hoop and Backboard for a Trampoline, provides a basketball game, the disclosure of which is incorporated herein by reference. Publicover shows a padded basketball hoop flexibly mounted to a backboard. When used with a trampoline, the advantage of this attachment is its shock absorption ability. The flex preserves the integrity of the basketball hoop, since users may bump against the structure while they are going up, potentially breaking the hoop if it were too rigid.

SUMMARY OF THE INVENTION

The trampoline basketball goal includes a frame, a bed and springs connecting the bed to the frame. The trampoline enclosure includes enclosure poles holding an enclosure net. The enclosure poles have an upper end and a lower end. The enclosure poles comprise a first enclosure pole, a second enclosure pole, and a third enclosure pole. The first enclosure pole, the second enclosure pole, and the third enclosure pole are placed around a periphery of the trampoline bed. The first trampoline pole is adjacent to the second trampoline pole, and the second trampoline pole is adjacent to the third trampoline pole. A basketball backboard is suspended between the first and third enclosure poles. A basketball hoop extends from the basketball backboard. A plurality of cables connect the basketball backboard to the upper end of the enclosure poles. The plurality of cables includes a first cable and a second cable. The first cable connects the basketball backboard to the first enclosure pole, and the second cable connects the basketball backboard to the third enclosure pole. The basketball backboard is suspended over the bed by the plurality of cables.

The first cable and the second cable can be continuous. The basketball hoop connector connects the basketball hoop to the basketball backboard in a breakaway configuration. The basketball backboard is inflatable. The enclosure net is made of enclosure netting suspended from an upper enclosure ring. A first grommet is attached to a right upper corner of the basketball backboard, and a second grommet is attached to a left upper corner of the basketball backboard. The first grommet forms a first corner connection, and the second grommet forms a second corner connection. The first cable connects to the first corner connection and the second cable connects to the second corner connection. The third upper cable connects between the second trampoline pole and the basketball backboard.

BRIEF DESCRIPTION OF THE DRAWINGS

FIG. 1 is a perspective view diagram of the present invention.

The following callout list of elements can be a useful guide in referencing the callout numbers of the drawings.

21 First Upper Cable
22 Second Upper Cable
23 Third Upper Cable
24 Upper Enclosure Ring
25 Enclosure Pole Caps
26 Trampoline Bed
31 Basketball Backboard
32 Basketball Hoop
33 Basketball Hoop Connector
34 Enclosure Pole
35 Trampoline Frame

36 Enclosure Netting
37 Frame Footing
38 Enclosure Pole Connector
39 Trampoline Pad
41 First Corner Connection
42 Second Corner Connection
43 First Grommet
44 Second Grommet
51 First Enclosure Pole
52 Second Enclosure Pole
53 Third Enclosure Pole

DETAILED DESCRIPTION OF THE PREFERRED EMBODIMENT

In a trampoline, a basketball goal can be mounted over the jumping area. A number of different cables can be attached to the basketball goal to connect the basketball goal to the enclosure poles of the trampoline. The cables can be bungee, elastic cords, rope and any other cords of similar construction. A basketball backboard 31 and a basketball hoop 32 can be mounted in a suspended position by connecting to cables. A first cable 21 and a second cable 22 connect upper corners of a basketball backboard 31 to top portions of enclosure poles 34. The first cable and the second cable can be tied to the enclosure pole connector caps 25. Optionally, the enclosure pole connector caps may have a separate opening for receiving the first cable and the second cable connections. The cables can be tied to the enclosure pole connector caps 25 by a slip knot such that excessive force on the basketball goal will cause the cables to detach safely in the unlikely event of the entanglement. Alternatively, the connector caps can have a breakaway portion for allowing breakaway a case of user entanglement in the cables.

The trampoline has enclosure poles 34 connected to the trampoline frame 35 by enclosure pole connectors 38, which can be screws or bolts. Enclosure netting 36 is suspended from an upper enclosure ring 24, and can have a sleeve for receiving portions of the upper enclosure ring 24. The upper enclosure ring can be made of fiberglass or metal. The enclosure netting is typically connected to the trampoline bed to hold a single user jumping on the trampoline bed. The enclosure poles can be about six to eight feet tall. Frame footings 37 can be assembled to the trampoline frame 35 to provide a support for the trampoline frame above a surface of the ground. Enclosure pole connector caps 25 can be mounted to the tops of the enclosure poles 34 and have grooved hook receivers for receiving the upper enclosure ring 24.

A third upper cable 23 can be connected between a rear portion of the basketball goal and a connector cap. The third upper cable 23 can be optional for providing additional stability. The third upper cable can loop downward and connect between the middle portion of the enclosure pole 34 and the rear portion of the basketball goal. The rear portion of the basketball goal can have a loop hardware for receiving the third upper cable to pass through it. Alternatively, the rear portion of the basketball goal can have a connector for receiving an end of the third upper cable.

A grommet can be used on a corner of the basketball backboard to frame an opening for forming a corner connection. More specifically, a first grommet 43 can form a first corner connection 41 and a second grommet 44 can form a second corner connection 42. A corner connection can be formed by forming an opening in the basketball backboard. The basketball backboard can be made of a fiberboard, wooden, plastic plank or can be inflatable. In the case of an inflatable basketball backboard, a small air pump could be used, however the basketball backboard would be better constructed by having a small air valve, and the basketball hoop would also be made inflatable to match the inflatable basketball backboard. On a smaller trampoline such as a fifteen foot diameter trampoline, it is not preferred to have a regulation sized basketball backboard, and a smaller basketball goal is preferred for smaller trampolines.

The basketball hoop connector 33 connects the basketball hoop 32 to the basketball backboard 31. The basketball hoop connector 33 is designed to break away in case of user entrapment and can be formed from hook and loop tape, magnetic attachment or can be a plastic piece such as a plastic hinge. A breakaway configuration is preferred a plastic hinge can be made to be easily breakable as well as capable of reassembly.

On a trampoline that has six enclosure poles 34, the basketball goal is mounted across three enclosure poles. The basketball goal is preferably mounted between a first enclosure pole 51 and a third enclosure pole 53 while skipping the second enclosure pole 52. The second enclosure pole 52 should be placed behind the basketball goal so that the third upper cable 23 can be attached to the second enclosure pole 52. The first cable and the second cable can be formed of a single continuous cable that passes from a right side connection on the first enclosure pole 51 to a left side on the third enclosure pole 53. In addition to the grommet connection, a sleeve can be formed along the top of the basketball goal along the top edge or rear of the backboard for receiving the single continuous support cable in a sheath so as to conceal the support cable.

The basketball backboard can have a variety of electronic enhancements commonly found in the industry for amusement basketball games. Such enhancements may include sounds and LED lights that activate when a goal is made, or a scorekeeping microprocessor. The basketball backboard is positioned over the trampoline bed. The goal is horizontally offset from the wall, preferably by a distance of at least 12 inches. The basketball goal can be changed or adjusted in position by having the cables adjustable. The cables can be adapted to carry electrical current when electronic components are included in the basketball goal. The cables preferably provide tension support.

The embodiments of the present invention are examples of the invention as claimed.

The invention claimed is:

1. A trampoline basketball goal comprising:

a. a trampoline comprising a frame, a bed and springs connecting the bed to the frame;

b. a trampoline enclosure including enclosure poles holding an enclosure net, wherein the enclosure poles have an upper end and a lower end, wherein the enclosure poles comprise a first enclosure pole, a second enclosure pole, and a third enclosure pole, wherein the first enclosure pole, the second enclosure pole, and the third enclosure pole are placed around a periphery of the trampoline bed, wherein the first trampoline pole is adjacent to the second trampoline pole, and wherein the second trampoline pole is adjacent to the third trampoline pole;

c. a basketball backboard;

d. a basketball hoop extending from the basketball backboard; and e. a plurality of cables connecting the basketball backboard to the upper end of the enclosure poles, wherein the plurality of cables includes a first cable and a second cable, wherein the first cable connects the basketball backboard to the first enclosure pole, and wherein the second cable connects the basketball backboard to the third enclosure pole, wherein the basketball backboard is suspended over the bed by the plurality of cables.

2. The trampoline basketball goal of claim 1, wherein the first cable and the second cable are made from one continuous cable that passes from a right side connection on the first enclosure pole to a left side connection on the third enclosure pole.

3. The trampoline basketball goal of claim 1, wherein a basketball hoop connector connects the basketball hoop to the basketball backboard in a breakaway configuration.

4. The trampoline basketball goal of claim 1, wherein the basketball backboard is inflatable.

5. The trampoline basketball goal of claim 1, wherein the enclosure net is made of enclosure netting suspended from an upper enclosure ring.

6. The trampoline basketball goal of claim 1, wherein a first grommet is attached to a right upper corner of the basketball backboard, and wherein a second grommet is attached to a left upper corner of the basketball backboard, wherein the first grommet forms a first corner connection, and wherein the second grommet forms a second corner connection, wherein the first cable connects to the first corner connection and wherein the second cable connects to the second corner connection.

7. The trampoline basketball goal of claim 1, wherein the plurality of cables further includes: a third upper cable connecting between the second trampoline pole and the basketball backboard.

8. The trampoline basketball goal of claim 1, wherein the plurality of cables are elastic and configured in tension.

9. The trampoline basketball goal of claim 1, wherein the first cable and the second cable are made from one continuous cable that passes from a right side connection on the first enclosure pole to a left side connection on the third enclosure pole.

10. The trampoline basketball goal of claim 8, wherein a basketball hoop connector connects the basketball hoop to the basketball backboard in a breakaway configuration.

11. The trampoline basketball goal of claim 8, wherein the basketball backboard is inflatable.

12. The trampoline basketball goal of claim 8, wherein the enclosure net is made of enclosure netting suspended from an upper enclosure ring.

13. The trampoline basketball goal of claim 8, wherein a first grommet is attached to a right upper corner of the basketball backboard, and wherein a second grommet is attached to a left upper corner of the basketball backboard, wherein the first grommet forms a first corner connection, and wherein the second grommet forms a second corner connection, wherein the first cable connects to the first corner connection and wherein the second cable connects to the second corner connection.

14. The trampoline basketball goal of claim 8, wherein the plurality of cables further includes: a third upper cable connecting between the second trampoline pole and the basketball backboard.

* * * * *